United States Patent [19]

Mandel et al.

[11] Patent Number: 4,884,415

[45] Date of Patent: Dec. 5, 1989

[54] HEAT TRANSFER BARRIER FOR THE YODER LOOP OF A REFRIGERATOR CABINET

[75] Inventors: Sheldon W. Mandel; Chinmoy Banerjee, both of Galesburg, Ill.

[73] Assignee: Maytag Corporation, Newton, Iowa

[21] Appl. No.: 250,605

[22] Filed: Sep. 29, 1988

[51] Int. Cl.[4] ..... F25B 47/00

[52] U.S. Cl. ..... 62/277; 62/444; 62/447; 312/214

[58] Field of Search ..... 62/277, 441, 447; 312/214

[56] References Cited

U.S. PATENT DOCUMENTS

| | | | |
|---|---|---|---|
| 1,992,011 | 2/1935 | Knight . | |
| 2,135,091 | 11/1938 | Newill . | |
| 2,141,918 | 12/1938 | Knigh . | |
| 2,258,959 | 10/1941 | Potter . | |
| 2,537,314 | 1/1951 | Mortensen . | |
| 3,157,306 | 11/1964 | Courson | 62/277 X |
| 3,376,711 | 4/1968 | Hagendoorn et al. | 62/410 |
| 3,835,660 | 9/1974 | Franck | 62/277 |
| 3,984,223 | 10/1976 | Whistler, Jr. | 62/81 |
| 4,550,576 | 11/1985 | Tate, Jr. et al. | 62/441 |
| 4,714,304 | 12/1987 | Sisk et al. | 312/214 |

*Primary Examiner*—Lloyd L. King

*Attorney, Agent, or Firm*—Bacon & Thomas

[57] ABSTRACT

Heat transfer between metal surfaces warmed by a condenser yoder loop and the storage compartments of a refrigerator is prevented by forming a longitudinal rib around the outwardly extending flanges of the compartment liners, whereby engagement of the external surfaces of the ribs by the door gaskets form positive heat transfer barriers between the warm metal surfaces and the interiors of the compartments.

4 Claims, 3 Drawing Sheets

HEAT TRANSFER BARRIER FOR THE YODER LOOP OF A REFRIGERATOR CABINET

BACKGROUND OF THE INVENTION

1. Field of the Invention

The present invention generally involves the field of technology pertaining to refrigerated cabinets. More specifically, the invention relates to the structure of a refrigerated cabinet wherein a condenser tube yoder loop is provided adjacent the mullion bar and external metal flanges of the cabinet.

2. Description of the Prior Art

A conventional refrigerator is usually defined by insulated freezer and fresh food compartments which are disposed in either a side-by-side or top mount configuration. In constructing the refrigerator cabinet, a single integrally molded liner may be used for defining the general interior storage space of a cabinet. An insulated partition is inserted into the liner to divide the storage space into the separate freezer and fresh food compartments, with the assembled liner and partition being thereafter inserted into the metal outer shell of the cabinet. Insulation is disposed in the wall space between the liner and outer shell. In some cases, the liner and portions of the partition may also be integrally molded.

A refrigerator cabinet having such freezer and fresh food compartments is usually provided with a yoder loop defined by hot refrigerant gas tubing located around the cabinet shell access opening with the yoder loop having one end connected to the outlet of the refrigerant condenser and the loop gas exit connected to a refrigerant filter and thereafter to the evaporator section through a capillary supply tube extending through a suction conduit. The yoder loop is disposed with a metal mullion bar and external flanges of the outer shell in order to provide the refrigerator cabinet with an inexpensive and efficient heat transfer, whereby the heat of condensation of the hot refrigerant gas is used to prevent condensation of moisture adjacent the front door openings of the freezer and fresh food compartments. The external flanges of the outer shell form a continuous extension of the mullion bar, the latter extending along the front of the partition.

However, the metal mullion bar and outer shell flanges surrounding the openings of the freezer and fresh food compartments are normally exposed to the refrigerated temperatures of the compartments, thus resulting in a large amount of undesirable heat transfer from the warm metal surfaces into the respective compartments. Since the mullion bar and corresponding outer shell flanges of the freezer compartment are exposed to a temperature of 0° F. and the mullion bar and corresponding outer shell flanges of the fresh food compartment are exposed to a temperature of 38° F., it is apparent that this undesirable heat transfer imposes an additional load on the central refrigeration system. This situation results in inefficiency in the operation of the refrigerator and consequent increased cost of operation.

SUMMARY OF THE INVENTION

It is an object of the present invention to provide a refrigerator having freezer and fresh food compartments with improved efficiency of operation.

It is another object of the invention to provide an improved construction for the plastic liner defining the freezer and fresh food compartments of a refrigerator whereby heat transfer from the warm metal mullion bar and outer shell flanges of a yoder loop to the refrigerated compartments is prevented.

It is a further object of the invention to provide an improved refrigerator structure which is economical to manufacture and provides enhanced maintenance of the required refrigeration temperatures of the freezer and fresh food compartments.

These and other objects of the invention are realized by forming the outwardly directed edges of the plastic compartment liners with inwardly offset portions which are received within corresponding slots of the metal mullion bar and outer flanges of the metal cabinet shell. This disposes the external surfaces of the mullion bar and outer flanges in a coplanar relationship with the corresponding external surfaces of the compartment liner edges, thereby collectively defining a flat joint sealing surface around the peripheral opening of each compartment for engagement by the corresponding peripheral gasket carried by each compartment door. This configuration permits the outwardly extending edges of the plastic liner to define rib-shaped barriers that effectively prevent heat transfer from the warm metal surfaces to the interior spaces of the compartments, thereby enhancing the energy conserving efficiency of the refrigeration system.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
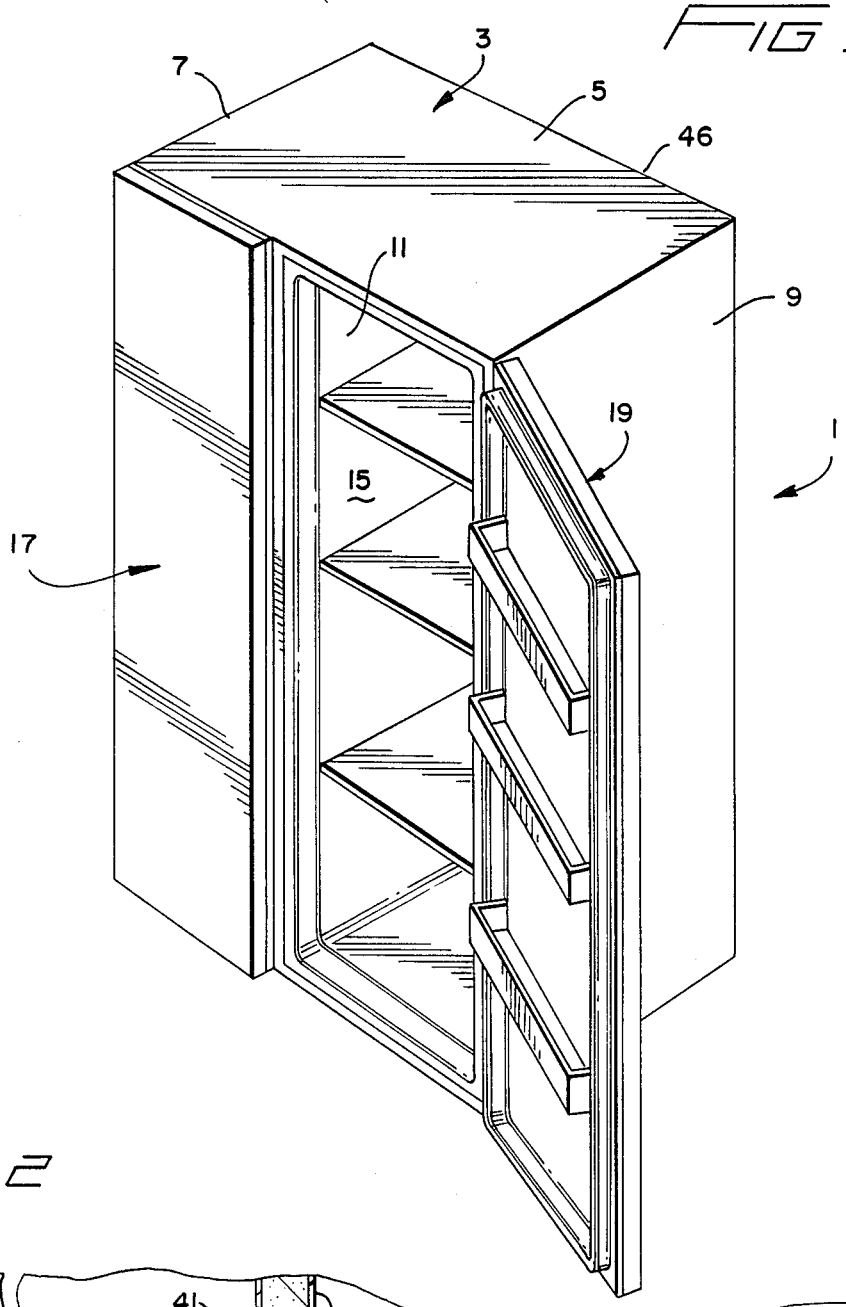
FIG. 1 is a perspective view of a side-by-side refrigerator, shown with the door of the fresh food compartment in an open position, incorporating a heat transfer barrier according to a preferred emodiment of the invention.
Figure 2:
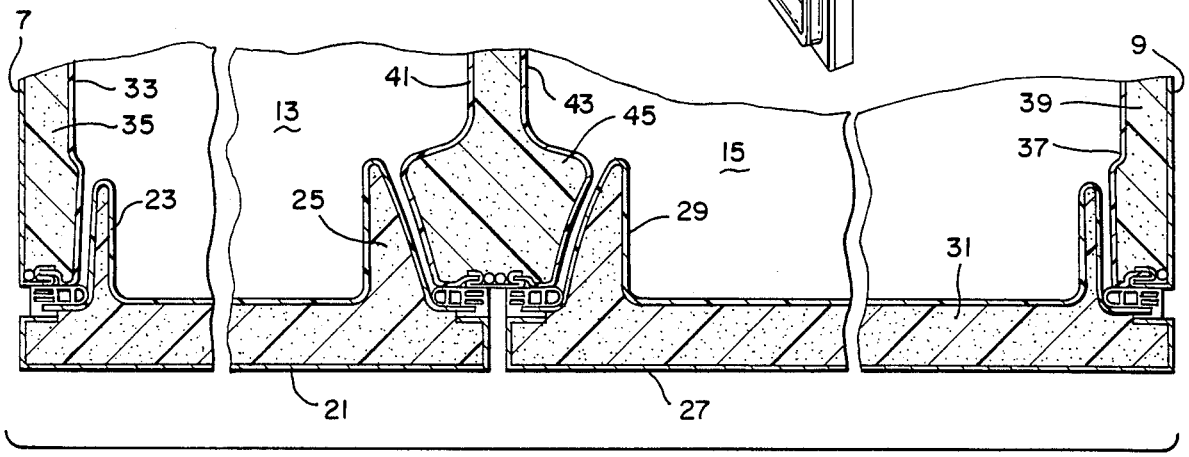
FIG. 2 is a partial top cross sectional view of the refrigerator shown in FIG. 1, depicted with both the door of the freezer compartment and the door of the fresh food compartment in their respective closed positions.

A preferred embodiment of the invention shall now be described with initial reference to FIGS. 1 and 2 of the drawings. As shown therein, a conventional side-by-side refrigerator cabinet 1 includes a metal outer shell 3 having a top section 5 and a pair of opposed side sections 7 and 9. The interior of cabinet 1 includes a vertically extending partition 11 which divides the interior into a freezer compartment 13 and a fresh food compartment 15. Freezer compartment 13 is provided With a door 17 that is hinged at the outer edge of cabinet 1 for swinging open about a vertical pivot axis. Likewise, fresh food compartment 15 is provided with a similar door 19 that is also hinged along an opposed edge of cabinet 1 for swinging open about a vertical pivot axis.

Door 17 is formed from an outer metal shell 21 and a spaced plastic liner 23, with a layer of appropriate thermal insulation 25 disposed therebetween. Similarly, door 19 is formed from an outer metal shell 27 and a spaced inner plastic liner 29, with a layer of thermal insulation 31 disposed therebetween.

Freezer compartment 13 is also formed from an inner plastic liner 33 that is spaced from top and side sections 5,7, with a layer of thermal insulation disposed therebetween. In the same manner, fresh food compartment 15 is also formed from an inner plastic liner 37 that is spaced from top and side sections 5,9, with a layer of thermal insulation 39 disposed therebetween. Partition 11 is formed from a pair of spaced plastic liners 41 and 43, with a layer of thermal insulation 45 disposed therebetween. Under conventional practice, it is possible that liners 33, 37, 41 and 43 be either of integral or sectional construction. Though not depicted herein, it is understood that a rear section 46 of cabinet 1 be also provided with appropriate insulating construction, including plastic liner structures forming integral or separate portions of compartments 13 and 15.

The particular details of a preferred embodiment of the invention shall now be described with reference to FIG. 3. As indicated therein, the front vertical face of partition 11 is defined by a metal mullion bar 47 and a pair of opposed outwardly directed plastic flanges 49 and 51 of liners 41 and 43, respectively. Directly behind mullion bar 47 is provided a yoder loop tube 53 through which hot refrigerant gas is circulated so that the heat of condensation of the refrigerant gas is utilized to prevent condensation of moisture adjacent the front door openings of freezer and fresh food compartments 13 and 15. Yoder loop tube 53 may also extend around the top, sides and bottom of the front door openings of compartments 13 and 15 in an appropriate manner well known in the refrigeration art.

Figure 3:
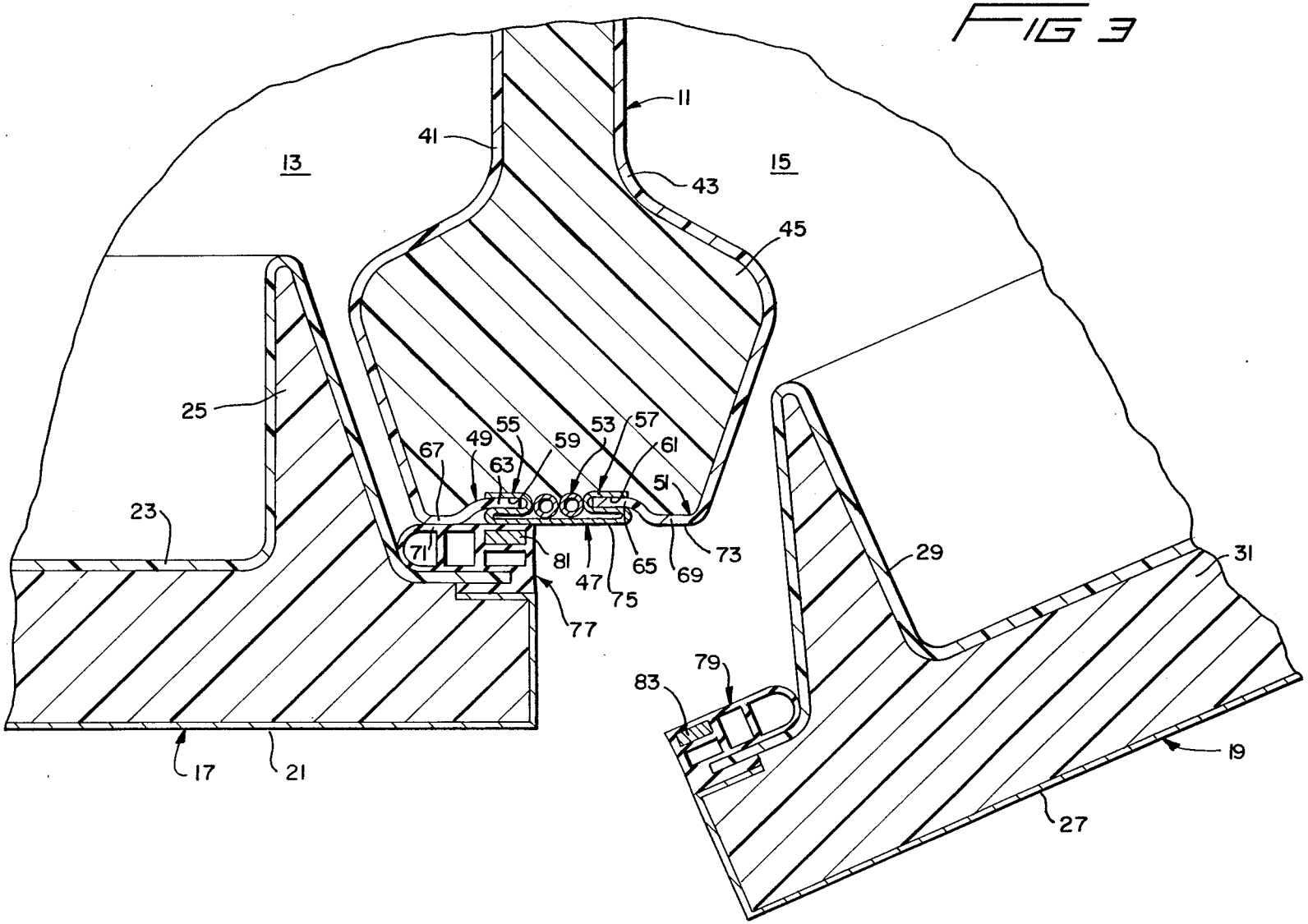
FIG. 3 is a partial top cross sectional view of the refrigerator of FIG. 1, particularly showing the partition between the freezer and fresh food compartments, with the door of the freezer compartment in a closed position and the door of the fresh food compartment in a partially open position.

As particularly noted in FIG. 3, mullion bar 47 is provided with inwardly and outwardly turned longitudinal flanges 55 and 57, each of which is of an oppositely directed S-shaped transverse configuration. Flange 55 forms an outwardly directed longitudinal slot 59 and flange 57 forms an identical oppositely directed longitudinal slot 61. Plastic flange 49 includes an inwardly offset longitudinal edge 63 that is engaged within slot 59. Likewise, plastic flange 51 also includes an inwardly offset longitudinal edge 65 that is engaged within slot 61. Thus, plastic flanges 49 and 51 define longitudinal ribs 67 and 69, respectively. Rib 67 includes a longitudinal external surface 71, and rib 69 is also provided with a similar longitudinal external surface 73. It is important to note that surfaces 71 and 73 are positioned in a substantially coplanar relationship with a corresponding longitudinal external surface 75 of mullion bar 47. In this manner, surface 71 and an adjacent portion of surface 75 collectively define a flat sealing surface against which a peripheral gasket 77 carried by door 17 is engaged when door 17 is in its fully closed position. Likewise, a similar peripheral gasket 79 carried by door 19 engages a flat sealing surface collectively defined by surface 73 and an adjacent portion of surface 75 in the same manner. Gaskets 77 and 79 are of conventional construction, and preferably formed of flexible plastic material, and also provided with a pair of magnetic strips 81 and 83, respectively, for latching against mullion bar 47 in a manner well known in the art.

By virtue of this arrangement, heat from the warm metal surfaces of mullion bar 47 is prevented from transferring directly into either freezer compartment 13 or fresh food compartment 15 when their respective doors 17 and 19 are in the fully closed positions. This is realized because of the sealing engagement between external surface 71 of rib 67 against gasket 71 and external surface 73 of rib 69 against gasket 79. Since ribs 67, 69 and gaskets 77 and 79 are formed of plastic material, the possibility of any significant heat transfer from mullion bar 47 into compartments 13 and 15 is prevented. It is further advantageous that insulation layer 45 in partition 11 be increased over conventional practice in order to define an enhanced thermal barrier.

Figure 4:
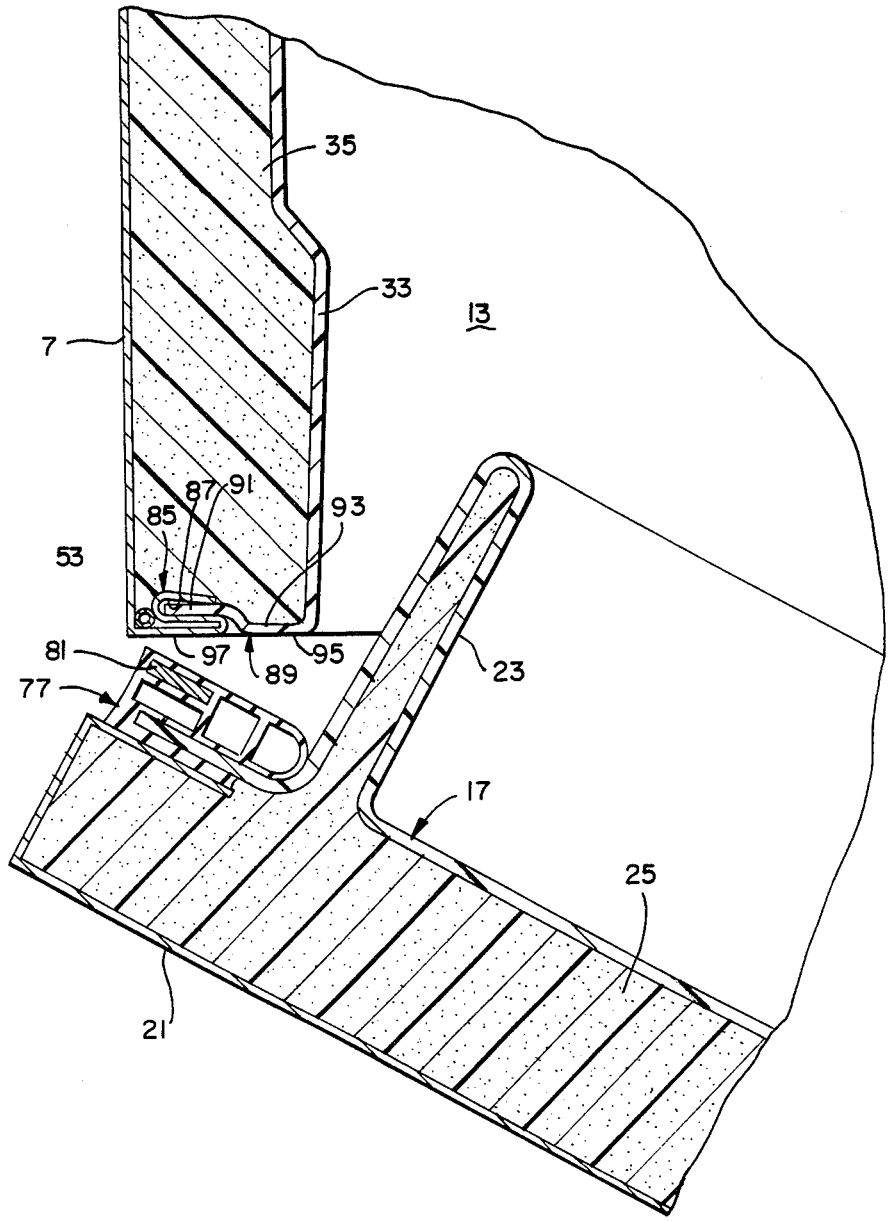
FIG. 4 is a partial top cross sectional view of the refrigerator of FIG. 1 showing the hinged side of the freezer door in a partially open position.

With reference to FIG. 4, there is shown side section 7 of cabinet outer shell 3 being provided with an inwardly directed flange 85 having the same basic configuration previously described for flanges 55 and 57 of mullion bar 47. Flange 85 also includes an inwardly directed slot 87. Plastic liner 33 is provided with an outwardly directed plastic flange 89 that includes an inwardly offset longitudinal edge 91 which is disposed within slot 87 and a longitudinal rib 93 having an external surface 95. As apparent, surface 95 is substantially coplanar with an external surface 97 of flange 85 to collectively define a flat sealing surface therewith for engagement by gasket 77. Yoder loop tube 53 may also extend along flange 85 for warming same. It is thus seen that this arrangement permits rib 93 to define an effective thermal barrier against the transfer of heat from warmed flange 85 into freezer compartment 13 by virtue of the engagement between external surface 95 and gasket 77. It is further contemplated that the arrangement shown in FIG. 4 shall extend peripherally around the sides, top and bottom of cabinet 1 so that, together with the arrangement shown in FIG. 3, a complete peripheral thermal barrier may be provided around the openings of freezer compartment 13 and fresh food compartment 15 when their respective doors 17 and 19 are in the fully closed positions.

In a typical refrigeration environment within which the invention is intended to be incorporated, the metal mullion bar and outer peripheral flanges of the metal cabinet shell are exposed to various ambient conditions of temperature and humidity in order that condensation be prevented from accumulating on these metal components in a high humidity and temperature environment, for example, 90° F. These components are required to be maintained at a temperature above their dew point by circulating hot refrigerant gas through the adjacent yoder loop tube. In a production refrigerator, these warm metal components are exposed to a cold freezer compartment temperature of about 0° F. and a fresh food compartment temperature of about 38° F. Since a conventional door seal arrangement permits free communication between the warm metal surfaces of the mullion bar and external flanges of the outer cabinet shell, and the interior of the refrigerator compartment, an undesirable heat transfer occurs from the metal components to the compartment, thereby requiring additional energy to maintain the desired compartment temperature. As is apparent, the invention permits the formation of an effective thermal barrier between the warm metal components and the interior of the refrigerator compartments when the doors are in their fully closed positions, thereby affording energy efficient operation of the central refrigeration system.

Though the invention has been described in combination with a side-by-side refrigerator structure, it may also be advantageously utilized with refrigerators of other configurations, such as wherein the freezer and fresh food compartments are disposed in a vertical or top mount array. It is further also contemplated that the invention may be utilized in providing an efficient thermal barrier seal for a single refrigerator compartment, as well as plural refrigerator compartments in both commercial and residential applications. It is to be understood that the form of the invention herein shown and described is to be taken as a preferred embodiment thereof, and various changes in shape, material, size, and arrangement of parts may be resorted to without departing from the spirit of the invention or scope of the subjoined claims.

What is claimed is:

1. A heat transfer barrier for the interior storage space of a refrigerated compartment formed by a plastic liner provided with an access opening having a peripheral surface engageable by a corresponding gasket of a compartment door, the peripheral surface of the access opening being defined by an outwardly extending plastic flange of the plastic liner and an inwardly directed external metal flange provided with a longitudinal slot, a longitudinal edge of the plastic flange being disposed within the longitudinal slot, and a yoder loop tube adjacent the metal flange for heating same, the improvement comprising the longitudinal edge of the plastic flange being inwardly offset to define an outwardly extending rib having an external surface disposed in a substantially coplanar relationship with and adjacent to a corresponding external- surface of the metal flange, the external surfaces of the rib and metal flange collectively defining a flat sealing surface extending around the periphery of the access opening for engagement by the door gasket to form a barrier against the transfer of heat from the metal flange to the interior storage space when the door is in a closed position.

2. The heat transfer barrier of claim 1, wherein the metal flange is in part defined by a metal mullion bar disposed along an external face of a partition dividing the refrigerated compartment into two separate storage spaces.

3. The heat transfer barrier of claim 2, wherein the metal flange is of a substantially S-shaped configuration having inner and outer portions, the outer portion defining the longitudinal slot for receiving the longitudinal edge of the plastic flange and the inner portion defining an inwardly directed slot, the width of the inwardly directed slot being substantially equal to the inward offset of the longitudinal edge of the plastic flange.

4. An energy efficient refrigerator cabinet comprising separate freezer and fresh food compartments, each compartment including an access opening and a closure door provided with a gasket for sealingly engaging a peripheral surface of the access opening, each compartment being defined by a plastic liner and a partition, the liner and partition collectively provided with an outwardly directed plastic flange around the access opening, a metal mullion bar extending along an external face of the partition and including oppositely directed longitudinal slots, an outer metal cabinet shell with inwardly directed flanges provided with longitudinal slots around the openings of the compartments, the edges of the plastic flanges being disposed within the slots of the mullion bar and shell flanges, a yoder loop tube behind the mullion bar and shell flanges for heating same, the edges of the plastic flanges being offset inwardly to define an outwardly extending rib around each access opening, each rib having an external surface disposed in substantially coplanar relationship with and adjacent to corresponding external surfaces of the mullion bar and shell flanges, the external surfaces of the rib, mullion bar and shell flanges of each access opening collectively defining a joint sealing surface around the periphery of each access opening for engagement by the gasket of the door to form a barrier against the transfer of heat from the mullion bar and shell flanges to the interior of and compartment.

* * * * *